United States Patent [19]

Found

[11] 3,951,726

[45] Apr. 20, 1976

[54] DEVICE FOR STRIPPING, DISPENSING AND APPLYING ADHESIVE TAPE

[75] Inventor: George H. Found, Kearsarge, N.H.

[73] Assignee: G. H. Found Corporation, North Conway, N.H.

[22] Filed: Oct. 15, 1974

[21] Appl. No.: 514,406

[52] U.S. Cl. ..... 156/527; 156/577; 156/579

[51] Int. Cl.[2] ..... B32B 31/00

[58] Field of Search ..... 156/523, 526, 528, 574, 156/577, 579, 522, 250, 461, 465, 527

[56] References Cited

UNITED STATES PATENTS

| | | | |
|---|---|---|---|
| 971,133 | 9/1910 | Maynes | 156/526 |
| 1,026,446 | 5/1912 | Kennedy et al. | 156/526 |
| 2,663,444 | 12/1953 | Kaplan | 156/523 |
| 3,403,066 | 9/1968 | Ikelheimer | 156/577 |
| 3,472,724 | 10/1969 | Casey | 156/523 |
| 3,666,601 | 5/1972 | Wuerch | 156/577 X |

*Primary Examiner*—William A. Powell
*Assistant Examiner*—M. G. Wityshyn
*Attorney, Agent, or Firm*—Richard P. Crowley

[57] ABSTRACT

A tape device which provides for the stripping, dispensing and applying of an adhesive tape onto a work surface, which tape device comprises a rack and pinion gear to drive a pair of spools between stripping and dispensing positions, a unidirectional first spool adapted to strip the tape from a tape roll, the unidirectional second spool, in conjunction with the groove roller, adapted to dispense a longitudinally creased rigidized piece of strip tape, the first and second spools characterized by tape-repellant surfaces, and a cutting blade within a flexible elongated snout, the cutting blade adapted to cut the stripped and dispensed tape after application of the tape by the snout to the work surface.

15 Claims, 9 Drawing Figures

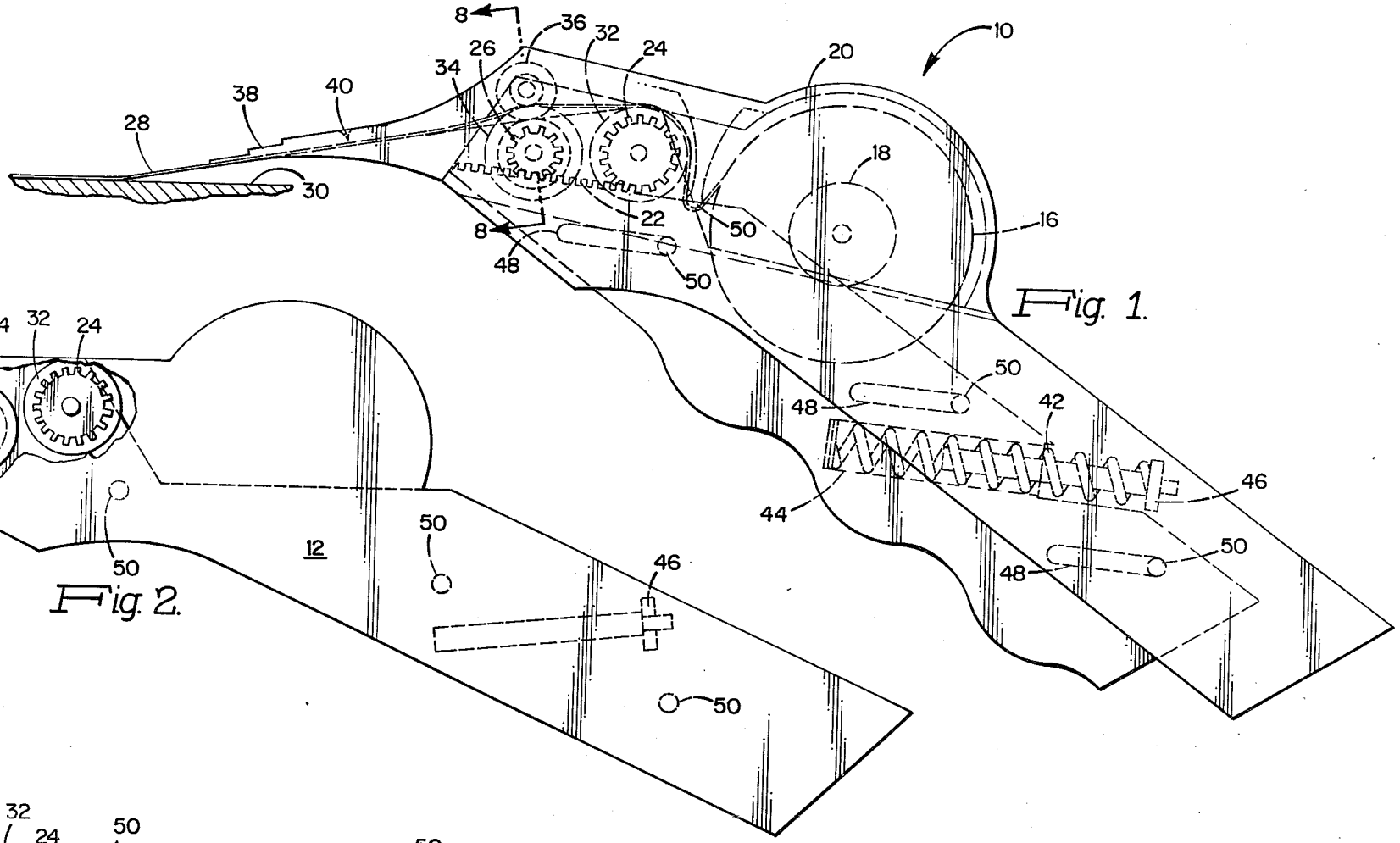
Fig. 1.
Fig. 2.
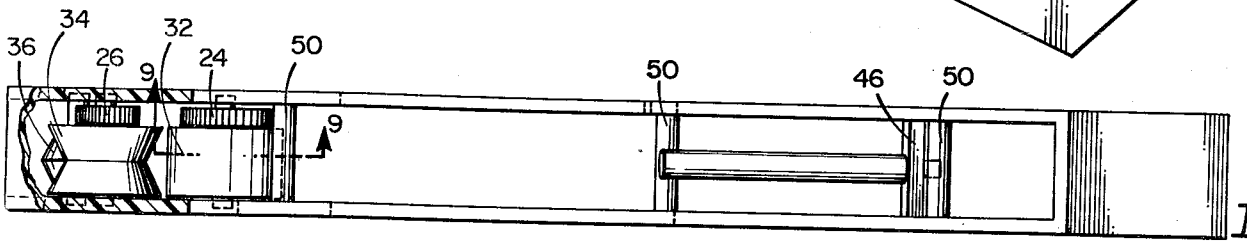
Fig. 3.

DEVICE FOR STRIPPING, DISPENSING AND APPLYING ADHESIVE TAPE

BACKGROUND OF THE INVENTION

Tape devices employed, for example, to dispense pressure-sensitive tape range from simple tape devices wherein the operator merely pulls the pressure-sensitive tape from the tape roll and then cuts the desired length of tape from the roll by exerting manual pressure on a cutting blade, or to more complex devices wherein various mechanisms are employed to dispense and cut the tape. Some prior art devices provide for stripping tape from a bulk roll by tension applied by the operator to the tape between the roll and the surface to which the tape is being applied. In some devices, the stripping action depends upon the mechanical entrainment or durations in or along the side of the pressure-sensitive tape, and all provide means for cutting the tape after application. However, in all the prior art devices, there does not exist a simple, compact, efficient tape device to perform the functions of stripping, dispensing, applying and cutting pressure-sensitive tape.

SUMMARY OF THE INVENTION

My invention is directed to a tape device to apply tape, particularly pressure-sensitive adhesive-type tape on one or both surfaces, onto a work surface, and more particularly to a device which strips, dispenses, applies and cuts the desired segment of tape. More particularly my invention is directed toward a hand-operated tape device which is small, compact, simple in operation and hand-operated, and which provides for the application of a tape from an adhesive roll or a similar bulk-supply package onto a work surface.

My tape device provides multifunctional operations not found in prior art dispensers for pressure-sensitive tape. My device, although simple in nature, provides for stripping the tape from a bulk roll by tension developed within the device, and, unlike prior art tape devices, does not depend on the tension developed by the operator between the roll and work surface to which the dispensed tape is being applied. Furthermore, my device dispenses the stripped tape and forcibly delivers the stripped tape in a structurally managable stiffened, rigidized ribbon or strip form through a separate action in the tape device. My device also permits the application of the stripped and dispensed tape to a work surface through the employment of a flexible elongated snout-like device, preferably of a polymeric resilient material, such as one composed of a soft or elastomeric natural or synthetic polymeric material. After application of the stripped, dispensed and applied tape to a particular work surface, my tape device provides further optional features for the cutting of the tape, either before or after application to the surface.

My device may be employed, not only on adhesive and pressure-sensitive tapes having either one or both sides coated with a pressure-sensitive adhesive, but also may be employed with other tapes or strips, whether pressure-sensitive or not, from a roll or similar bulk-supply package.

My tape device in the stripping section utilizes the frictional forces developed principally from the geometric vector forces of the pressure tape wrapped around a nonadhering pull surface, and not from the pull developed by the tacky nature or adhesion of the pressure-sensitive surface. The stripping of a pressure-sensitive tape in my device does not depend upon the mechanical entrainment or seration along the length of the tape, which substantially reduces sticking and releasing problems occasioned when a human finger or other surface makes normal contact with the pressure-sensitive surface. The surface of the stripping spool element employed in my tape device is a durable, chemically repellant, nonadhesive surface which, because it has no affinity for adhesive and is properly vectored, permits rapid and effective stripping of the tape from my device.

The stripping and dispensing actions within my tape device depend upon the version of a hand-gripping mechanism and the means to actuate a rack and pinion gear to move first and second spools; thus, converting the reciprocating action of the rack and pinion through a rotary motion of the first and second spools. The rack and pinion may, of course, be also actuated by other means, such as a wind-up spring, electric motor or other common actuating means where heavier and more complex devices are desired.

In my tape device, a stripping section includes a first spool actuated by the movement of the rack and pinion gears, and wherein the first spool is adapted for unidirectional rotation to strip the tape from a tape source. In addition, in my tape device, a second spool is also actuated by the rack and pinion gears and permits the dispensing of the stripped tape in cooperation with a roller whereby the stripped tape is longitudinally creased to rigidize the tape prior to application. A combination of a first unidirectional spool and a second unidirectional spool permits the device to strip and dispense the tape in measured lengths controlled by the operator, and, further, permits the device to be capable of delivering when desired the tape in a free-wheeling fashion; that is, by tape tension developed between the work surface and the supply roll of tape.

My device includes a flexible elongated element so that the stripped and dispensed tape may be applied by operator pressure onto the desired work surface, and, thereafter, cut by a cutting blade in the proper amount when stripped and dispensed in the proper length. Thus, my tape device strips, dispenses, applies and cuts in a single actuating operation pressure-sensitive tape.

My tape device, because of its ability to strip and dispense and apply pressure-sensitive tape by coupling vector forces on repellant surfaces, in combination with unidirectional spool gears with rotary motion, is actuated by a reciprocating rack and pinion gear, makes unnecessary the use of protective coatings through paper laminations on the tacky surface of the pressure-sensitive tape, which surfaces are employed in many types of tape products. In addition, my tape device provides a means for which ancillary or piggy-back accessories to perform other functions may be easily incorporated, such as to provide a platform for integral printing, piercing or laminating the tape prior to application.

My tape device thus performs the actions of stripping, dispensing, applying and cutting tape, particularly pressure-sensitive tape, which device comprises in combination a source of tape, particularly a rotary spool of pressure-sensitive tape; means to strip the tape from the source, which means comprises a rack, particularly a straight-line rack, and first and second pinion gears wherein the rack is adapted for reciprocating movement between first and second positions to impart rotary motions to the first and second pinion gears, while the first and second gears are adapted to move in either rotary direction on reciprocating movement of the rack. The means to strip also includes means to move the rack reciprocally between the first stripping and second dispensing positions, such as by hand actuation between the first and second positions where the device is a hand-operating compact tape device. The device includes a first spool secured on a common axis with the first gear, with the spool adapted for unidirectional rotation, together with the movement of the first gear, whereby the tape from the tape source passes over at least about 90° of the external surface of the first spool, with the first spool preferentially being treated or comprised of a nonadhering surface, whereby on actuation of the means to move the rack between the first and second positions, a predetermined selected length of tape is stripped from the source of tape and passed onto the surface of the first spool. My tape dispenser also includes a means to dispense the tape which has been stripped which comprises a second spool and a cooperating roller between which the stripped tape is dispensed. The roller, in combination with the second spool, is adapted to crease longitudinally the stripped tape received from the first spool, the stripped tape passed between the rollers to provide for a stiffened rigidized tape to be dispensed therefrom. The second spool is secured on a common axis with the axis of the second gear, and is adapted for rotary unidirectional movement with the reciprocating movement of the second gear of the rack and pinion gears, whereby the stripped tape is dispensed through the groove rollers in a desired length on movement of the rack on the actuating means. The external surfaces of either the second spool or the cooperating roller used in combination therewith are so formed, such as concaved, convexed, embossed, knurled or otherwise, to provide for a creasing in longitudinal structure to be imparted to the stripped tape passed therebetween.

My tape device also includes a means to apply stripped and dispensed tape which, in one embodiment, comprises an elongated snout-like structure composed of a resilient or flexible material in a cavity therein, an inlet to receive the tape from the dispensing means, and an outlet typically tape-shape form; that is, slotted form, through which the stripped and dispensed tape passes, so that the tape may be applied to a particular work surface.

My tape device also includes a means to cut or sever the tape in a predetermined length after the tape has been stripped and dispensed. The severing means may be employed either before or after application of the tape to the work surface, and may comprise, for example, a cutting means, such as an angular-placed cutting blade placed between the outlet of the snout element and the means to dispense the tape.

DESCRIPTION OF THE DRAWINGS

FIG. 1 is an elevation view of an assembled hand-actuated tape device of my invention.

FIG. 2 is an elevation view and FIG. 3 is a plan view of the main body element of my tape dispenser.

DESCRIPTION OF THE EMBODIMENTS

Figure 4:
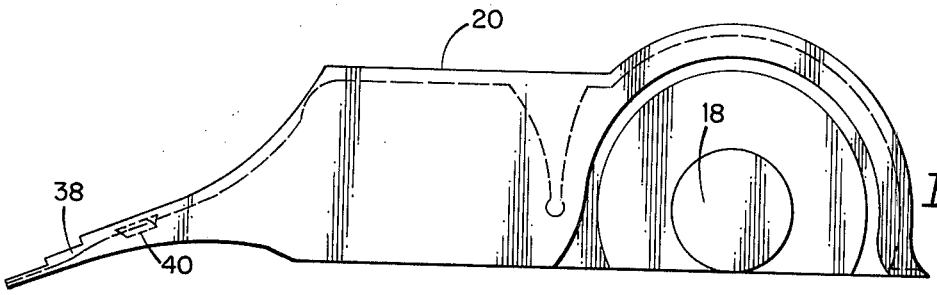
FIG. 4 is an elevation view and FIG. 5 is a plan view of a cover element of my tape device.
Figure 5:
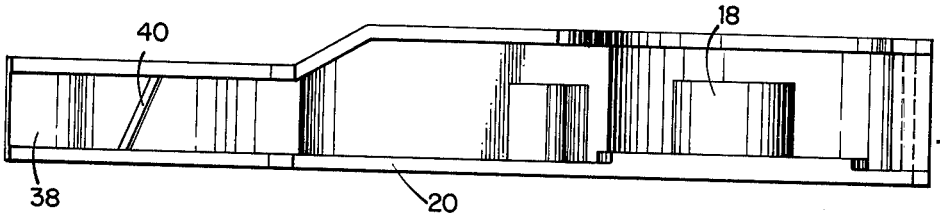
Figure 6:
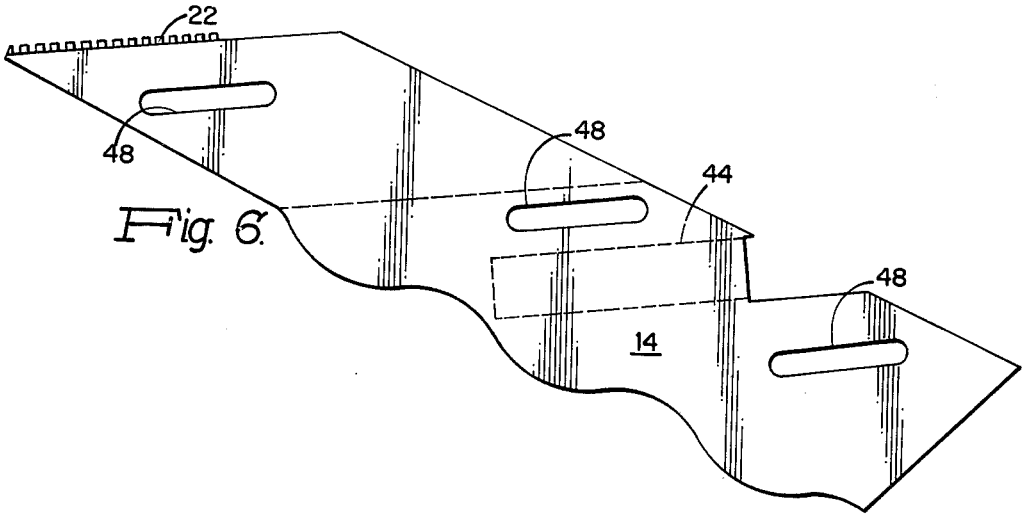
FIG. 6 is an elevation view and FIG. 7 is a plan view of a hand-actuator element of my tape device.
Figure 7:
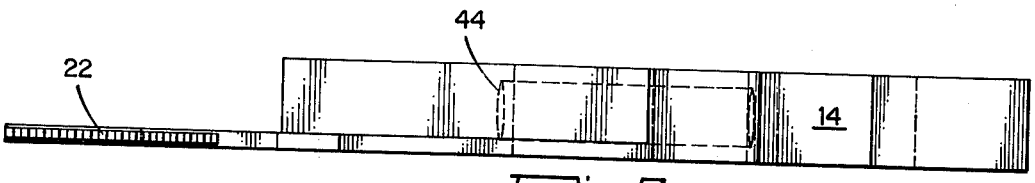

My tape device 10 comprises a main body pistol grip-type element 12 and a hand-actuating element 14, both composed of a hard, rigid, molded, inexpensive plastic and adapted to be placed in an operating cooperative engagement as illustrated. A cover element 20 composed of a transparent hard plastic cooperatively engages the top of the main body element 12, and includes at its farther end an elongated resilient snout tape applicator element 38 formed of a resilient flexible plastic material, the snout element having a cavity, and at its extreme end, having a flat slot-like cavity therein adapted for the passage of tape thereon. The snout structure has a graduated section modulus of decreasing value toward the outer end to provide functional operation along this cantelevering structure. The snout-like element is adapted to be pressed by the operator onto a work surface 30 to which the pressure-sensitive tape is to be applied, whereupon a stripped dispensed tape 28 to be applied is laid on the work surface prior to being severed.

Figure 8:
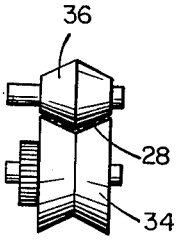
FIG. 8 is a cross-sectional view of the tape-dispensing section along lines 8—8 of FIG. 1.
Figure 9:
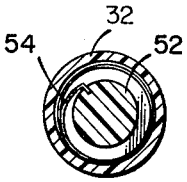
FIG. 9 is a cross-sectional view of the microclutch of the stripping section along lines 9—9 of FIG. 3.

My tape device 10 includes a roll of tape to be stripped, dispensed and applied, such as a single or double-coated roll of pressure-sensitive tape 16, the tape roll 16 supported on a spool 18 and integrally formed with the cover element 20. The hand-actuator element 14 includes a plurality of guide slots 48 and a spring-recess cavity 44, with the forward part of the element adapted to form a crib for the end of the holder. The upper portion of the element has formed therein a straight-line rack 22. The main body element 12 includes a first 24 and second 26 pinion gear mounted on a common axis, respectively, a unidirectional first stripping spool 32 and a unidirectional V-groove second dispensing spool 34. The pinion gears 24 and 26 are adapted for free-wheeling and rotary motion in either direction, while spools 34 and 36 are adapted for further use of an internal spring-biased microclutch mechanism (see FIG. 9) adapted for unidirectional rotary motion in a counterclockwise direction. Spool 32 is a flat smooth spool, both spools 32 and 34 composed or having their surfaces treated, such as with silicone resin or a tetrafluoroethylene plastic, so as to present a nonadhering low-friction surface which prevents, repels and inhibits the pressure-sensitive side of the pressure-sensitive tape 28 stripped, dispensed and applied from the roll from sticking or adhering to either external spool surface. The main body element also includes a cooperative, indent, free-wheeling roller 36, which roller, together with the spool 34, has its external surfaces so adapted to provide for a longitudinally creasing of the pressure-sensitive tape to be passed therethrough to impart structural integrity to the tape to rigidize the tape for the subsequent application and cutting operations. As illustrated, spool 34 is a concave V-type groove spool, while cooperative roller 36 comprises a convex V-groove roller which is in cooperation with high-longitudinal crease of the tape as shown more particularly in FIG. 8. Typically, the minimum diameter of the V-groove in spool 34 is equal to the external diameter of spool 32 or pinion gear 26 and is smaller as illustrated than gear 24 to accelerate spool 34.

My main body element 12 also includes a series of guides 50 which are adapted to move within the guide slots 48 of the hand-actuating element 14 in cooperative reciprocal actions. Main body element 12 also includes a spring seat 46 where a coiled spring 42 fits within the spring recess 44 of the hand-actuating element 14. The cover element, which may be transparent totally or at one end about the roll of tape 16 in order to provide a rapid visual determination by the operator as to the content of the tape roll which may be easily removed from the main body for replenishing the tape roll 16, includes a severing means which is illustrated as an angled, serated cutting blade 40. The unidirectional rotary motion of the spools 34 and 36 is provided by a spool clutch cavity 52 in each of the spools 34 and 36 and within the cavity a clutch microspring 54 so as to provide for only unidirectional rotation of the spools due to the tightening of the wound spring upon clockwise movement of the spools.

As illustrated more particularly in its assembled nonactuating position (FIG. 1), the hand-actuating element 14 is adapted to move between a nonactuating position as illustrated and an actuating position by a hand-squeezing action of the operator to move the hand-actuating element 14 to the right as illustrated. As shown in the assembled condition, the pressure-sensitive tape from the roll of tape 16 is passed pressure side down about a guide 50, and, hence, about the first quadrant of at least 90° against the flat smooth surface of the spool 32, and, hence, between the cooperating spool 34 and roller 36 beneath the cutting blade 40 and through the slotted end of the snout 38 so as to extend outwardly and be ready to be applied onto a work surface 30.

In operation, a roll of tape 16 is placed on the roll support 18, and the cover element 20 and the element threaded about the guide 50 and over the flat surface of spool 32 between cooperating spool 34 and roller 36 and out the tape outlet of snout 38. Snout 38, at least the lower section thereof, is composed of a plastic material or otherwise treated similarly to the surfaces of spools 34 and 36 in order to prevent adhesion of the pressure-sensitive side of the tape 28 from adhering to the snout section 38. Cover element 20 is then placed over the main body element 12. In this arrangement, if desired, tape 28 can be stripped from the tape roller 16 by the operator as desired in a free-wheeling operation, or the tape may be stripped, dispensed, applied and cut through the operation of my tape device.

For the effective operation of my device, the tape placed against the external surface of the first spool 32 must be placed in the first quadrant of that spool over an angle of at least 90° from the take-off position of the tape from the tape roller 16. The operator, on squeezing the fingers of his hand of the hand-actuating element 14, forces the coiled spring 42 in the spring recess 44 against the spring seat 46 in the main body element, and moves the guide 50 in each of the guide slots 48 backwards to the right, whereby the movement of the straight-line rack in cooperation with the first and second pinion gears 24 and 26 converts the straight-line action of the actuated hand squeeze into a rotary motion. The movement of the first and second pinion gears 24 and 26, on a common axis with and adapted to move the spools 32 and 34, moves the first spool 32 in a counterclockwise direction, stripping the desired amount of tape from the tape roller 16, and between the cooperating spool 34 and roller 36. As the stripped tape moves from the surface of the first spool 32 between the spool 34 and roll 36, the groove form of the external surfaces of the spool and roll form a longitudinal crease in the tape to rigidize the tape then passing through the cavity in the elongated snout 38 and through the slotted outlet onto a work surface.

The length of tape to be stripped and dispensed may be governed by a single squeeze or by a plurality of various squeezes by the operator. The tape is applied to a work surface 30 through placing the tape parallel at a slight angle with the work surface, and the operator's pressing down so that the resilient snout forces the stripped dispensed tape evenly onto the work surface. When sufficient tape 28 has been applied to the work surface 30, then a further hard downward movement by the operator brings the non-pressure-sensitive surface of the tape into contact with the angular serated cutting bar 40, and then the tape is severed in the desired length.

On the operator's releasing the hand-actuating element 14, the element is returned to its nonactuating position through the force of the coiled spring 42, while the microclutches within the spools 32 and 34 do not permit the rotary motion of the spools, so that the free-wheeling first and second pinion gears 24 and 26 move with the movement of the rack 22 from actuating or squeeze position to the nonactuating or rest position, ready for the stripping, dispensing and applying of the next tape segment.

The operation described is a single-action operation wherein both first and second spools rotate to advance the tape on one stroke unidirectional movement of the rack through operator action, with the return of the rack providing no movement in either spool. In an alternate embodiment, double action is also possible so as to provide for spool 32 to rotate and advance the tape by the squeeze of the hand-actuating element 14, and have the tape festoon between spools 32 and 34, with no rotary motion of spool 34 when the rack moves in one or the first direction. With return movement of rack element 14 on release of the squeeze action on the element 14; i.e., in the second or opposite direction, no movement is provided for spool 32, while the return action rotates spool 34 to dispense the festooned stripped tape. In the alternative double-action embodiment, the microclutch is merely secured to the spool 34 to permit unidirectional rotary motion of the spools, but in sequence rather than concurrently.

Various embodiments are, of course, possible within the spirit of my invention, such as, for example, the employment of other means to actuate the device other than the actuation by hand, or various cutting and severing means may also be employed. However, it is to be understood that the foregoing description of the drawings is described only as to the preferred embodiment of my invention and is for the purposes of illustration only, and that the apparatus and method of my invention are not limited to the precise details, conditions and structures disclosed herein, and various changes and modifications may be made therein without departing from the spirit of the invention or scope thereof which is defined by the following claims.

I claim:

1. A tape-dispensing device which comprises in combination:

a. a source of tape to be dispensed from the device;

b. a rack element constructed and arranged for reciprocating movement between an actuating and a nonactuating position;

c. first and second pinion gears, each in a separate cooperative intermesh engagement with the rack, whereby movement of the rack imparts rotary movement to the first and second gears;

d. a first spool secured on a common axis with the first pinion gear, whereby, on movement of the rack between a nonactuating and an actuating position, a predetermined length of tape is removed from the source of tape and placed in contact with the peripheral surface of the first spool;

e. a second spool secured on a common axis with the second pinion gear;

f. a roller constructed and arranged for cooperation with the second spool to impart a longitudinal-type crease to the tape passed between the cooperating peripheral surfaces of the roller and the second spool, whereby, on movement of the rack between a nonactuating and an actuating position, the tape is dispensed from the surface of the first spool between the roller and second spool, and a crease is placed in the tape to impart structural rigidity thereto;

g. clutch means which provides for the same unidirectional rotary movement of the first and second spools on movement of the rack from a nonactuating to an actuating position; and h. means to move the rack between a reciprocating actuating and a nonactuating position.

2. The device of claim 1 wherein the peripheral surfaces of both the first and second spools are characterized by a substantially nonadhering surface, and wherein the source of tape is a roll of tape having at least one adhesive surface.

3. The device of claim 2, wherein the source of tape is a roll of adhesive tape, the roll of tape and the first spool positioned and arranged with respect to each other so that the adhesive side of the tape from the roll of tape contacts the nonadhering surface of the first spool over approximately the first 90° quadrant of the first spool peripheral surface.

4. The device of claim 1 wherein the rack is a straight-line rack, the first and second pinion gears intermeshed with the rack in a separate side-by-side relationship, and the roller is a free-wheeling roller constructed and arranged above the second spool.

5. The device of claim 1 wherein the device includes an elongated snout-like element as a means to apply the dispensed tape, the element composed of a polymeric resilient material characterized by a cavity therein to permit the passage of the tape, an inlet at the one end to receive the longitudinally creased rigid tape, and an outlet at the other end through which the tape passes to deliver the tape to the surface to which it is to be applied.

6. The device of claim 5 which includes a cutting means to sever the tape, the means constructed and arranged between the inlet and outlet of the elongated element.

7. The device of claim 6 wherein the cutting means including a cutting blade disposed at an angle to the longitudinal axis of the tape and arranged to sever the tape when the elongated element is pressed downwardly toward the surface to which the tape has been applied.

8. The device of claim 1 wherein the first and second spools are characterized by a cylindrical cavity therein, and wherein the clutch means comprises a coiled spring closely fitted within each of the cavities and one end secured in the cavity, the spring by spring tension permitting only unidirectional movement of the first and second spools on movement of the rack between actuating and nonactuating positions.

9. The device of claim 1 wherein the first and second spools have an external peripheral coating of a silicone resin to provide a substantially nonadhering surface.

10. The device of claim 1 wherein the device includes a hand-grip element containing the first and second pinion gears and the first and second spools and roller, and a hand-actuating element in cooperation with the hand-grip element, the hand-actuating element having a straight-line rack at the top thereof to mate in a cooperating relationship with the first and second pinion gears, the hand-actuating element including a spring-actuating means whereby the operator, through a hand-squeeze action, may move the hand-actuating element in relation to the hand-grip element between a nonactuating to an actuating position, where, on release of such hand action, the hand-actuating element moves to a nonactuating position.

11. The device of claim 1 wherein the means to move the rack provides for movement of the first spool to strip the tape on movement of the rack in one direction from the nonactuating position to the actuating position without movement of the second spool, and provides for movement of the second spool to dispense the stripped tape on movement of the rack in the opposite direction from the actuating position back to the nonactuating position without movement of the first spool.

12. The device of claim 1 wherein the means to move the rack provides for concurrent movement of the first and second spools to strip and dispense the tape as the means moves the rack in one direction from a nonactuating to an actuating position.

13. The device of claim 1 wherein the source of tape is a pressure-sensitive adhesive tape, the peripheral surface of the first spool is characterized by a smooth flat surface, and the surface of the second spool and the roller is characterized by cooperating V-type grooves therein, the first and second spools further characterized by a substantially nonadhering surface to the pressure-sensitive adhesive tape.

14. An adhesive tape-dispensing device which comprises in combination:

a. a source of tape with an adhesive surface to be dispensed from the device;

b. a rack element constructed and arranged for reciprocating movement between an actuating and a nonactuating position;

c. first and second pinion gears, each in a separate cooperative intermesh engagement with the rack, whereby movement of the rack imparts rotary movement to the first and second gears;

d. a first spool secured on a common axis with the first pinion gear and having a peripheral spool surface characterized by a substantially nonadhering surface, whereby, on movement of the rack between a nonactuating and an actuating position, a predetermined length of adhesive tape is stripped from the source of tape, and the adhesive side of the tape is placed in contact with the peripheral surface of the first spool;

e. a second spool secured on a common axis with the second pinion gear and having a peripheral spool surface characterized by a substantially nonadhering surface;

f. a roller constructed and arranged for cooperation with the second spool to impart a longitudinal-type crease to the tape passed between the cooperating peripheral surfaces of the roller and the second spool, whereby, on movement of the rack between a nonactuating and an actuating position, the tape is dispensed from the surface of the first spool between the roller and the second spool and a crease placed in the tape to impart structural rigidity thereto;

g. clutch means which provides for the same unidirectional rotary movement of the first and second spools on movement of the rack from a nonactuating to an actuating position;

h. means to move the rack between a reciprocating actuating and nonactuating position;

i. means to receive and apply the dispensed tape; and j. means to sever the tape.

15. A tape stripping, dispensing, cutting and applying device, which device comprises in combination:

a. a pistol grip-type element;

b. a spring tension-biased hand-actuating element arranged to move in cooperation with the grip-type element in a reciprocating manner between a non-actuating and an actuating position by the spring bias;

c. a roll of pressure-sensitive adhesive tape from which roll the tape is to be stripped, dispensed and applied onto a work surface;

d. a straight-line rack on the upper surface of the hand-actuating element;

e. first and second pinion gears, the gears in a separate cooperating intermeshed relationship with the straight-line rack, the rack, on reciprocating movement between the non-actuating and actuating positions through the hand-squeeze action of an operator, imparting rotary motion to the first and second gears;

f. first and second spools, each spool secured on a separate common axis on the grip-type element with the first and second gears, respectively, each of the spools adapted for rotary unidirectional movement on the movement of the gears to strip and dispense the tape from the roll of tape, each of the spools characterized by a peripheral, substantially nonadhering surface to prevent the adhesion of the pressure-sensitive side of the tape to the surface of the spools;

g. a cooperative free-wheeling, indent roller in a cooperative relationship with the second spool, the second spool having a V-type groove therein, the roller and second spool arranged to impart a longitudinal-type crease into the nonadhesive side of the stripped tape to rigidize the tape passed between the roller and second spool and received from the surface of the first spool;

h. clutch means to provide for the first and second spools to move in only one direction on movement of the rack;

i. means to apply the stripped and dispensed tape, which means includes an elongated snout-like element to apply the dispensed tape, the element composed of a polymeric resilient material characterized by a cavity therein to permit the passage of the tape, an inlet at the one end to receive the longitudinally creased rigid tape, and an outlet at the other end through which the tape passes to deliver the tape to the surface to which it is to be applied; and j. means to sever the tape after dispensing, which means includes a cutting blade to sever the tape, the means constructed and arranged between the inlet and outlet of the elongated element.

* * * * *